United States Patent [19]

Burtis et al.

[11] 4,018,252

[45] Apr. 19, 1977

[54] ANTI-POLLUTION NOZZLE ASSEMBLY

[76] Inventors: Wilson A. Burtis, 5011 Harvard Ave., Westminster, Calif. 92683; William C. Babcock, 3732 Walker Lee Drive, Los Alamitos, Calif. 90720

[22] Filed: Sept. 22, 1975

[21] Appl. No.: 615,581

Related U.S. Application Data

[63] Continuation-in-part of Ser. No. 409,939, Oct. 26, 1973, Pat. No. 3,907,010.

[52] U.S. Cl. ..... 141/45; 141/59; 141/97; 141/226; 141/311 R

[51] Int. Cl.[2] ..... B65B 31/06

[58] Field of Search ..... 141/52, 59, 97, 207, 141/44, 45, 310, 290, 383, 384, 385, 386, 346, 347, 311, 392, 226

[56] References Cited

UNITED STATES PATENTS 3,899,009 8/1975 Taylor ..... 141/97

*Primary Examiner*—Houston S. Bell, Jr.
*Attorney, Agent, or Firm*—William C. Babcock

[57] ABSTRACT

An anti-pollution nozzle assembly that removably engages the fuel inlet tube on an automotive vehicle and removes fuel vapor from the tank thereof at a rate that varies with the rate at which fuel is discharged into said tank by said nozzle assembly, with the removed fuel vapor being returned to the fuel storage tank of the service station where the anti-pollution nozzle assembly is employed.

1 Claim, 3 Drawing Figures

ANTI-POLLUTION NOZZLE ASSEMBLY

CROSS-REFERENCE TO RELATED APPLICATIONS

The present application is a continuation-in-part of our co-pending application Ser. No. 409,939 filed Oct. 26, 1973 entitled, "Anti-pollution Service Station Assembly" that will issue as U.S. Pat. No. 3,907,010 on Sept. 23, 1975.

BACKGROUND OF THE INVENTION

1. Field of the Invention

Anti-pollution Nozzle assembly.

2. Description of the Prior Art

When liquid hydro carbon fuel (such as gasoline) is dispensed into the fuel tank of a motor vehicle, it displaces vapors from the tank. If these vapors are allowed to escape to the atmosphere, the hydrocarbons included therein would add to the air pollution problem. In addition, these vapors contain combustible material and present a fire hazard to the person performing the fueling operation.

A major object of the present invention is to provide an anti-pollution nozzle assembly of simplified design, that is simple and easy to use, and one that may be incorporated into either existing nozzles or new nozzles.

SUMMARY OF THE INVENTION

The invention is used in dispensing a volatile liquid hydrocarbon fuel into the fuel inlet tube of a tank without vapor of the fuel escaping to the ambient atmosphere. The invention includes a valve body assembly that has first and second concurrently operable spring-loaded valve members within the interior thereof that tend to remain in first positions. The first valve member, when in the first position, obstructs communication between first and second passages in the valve body assembly. The second valve member, when in the first position, obstructs communication between third and fourth passages in the valve body assembly. The valve body assembly is connected to a flexible hose through which liquid fuel is supplied to the first passage from a fuel reservoir.

A tubular nozzle is secured to the valve body assembly and is in communication with the second passage, with the nozzle of such transverse cross-section as to be slidably inserted within the fuel inlet tube. A resilient, longitudinally deformable, tubular shroud having first and second ends is provided, with the first end of the shroud sealingly supported from the valve body assembly. The shroud cooperates with the nozzle to define an annular shaped space therebetween that is in communication with the fourth passage, and the shroud at the second end thereof having a ring-shaped, radially tapered, resilient surface that sealingly engages the first end of the inlet tube when the nozzle is inserted therein to a predetermined extent. The third passage has a negative pressure maintained therein by a power-driven pump that operates concurrently with the pump that supplies fuel to the first passage. A manually operable, pivotally supported handle is provided on the valve body assembly for concurrently moving the first and second valve members from first positions towards second positions whereupon fuel flows through the first and second passages and the nozzle to the fuel inlet tube of the tank, and fuel vapor displaced by the liquid fuel entering the tank being drawn into the annulus-shaped space previously mentioned, and from this space through the third and fourth passages to be returned to the fuel reservoir at substantially the same rate as liquid fuel is discharged into the fuel tank of the vehicle.

DESCRIPTION OF THE PREFERRED EMBODIMENT

Figures 1, 2, 3:
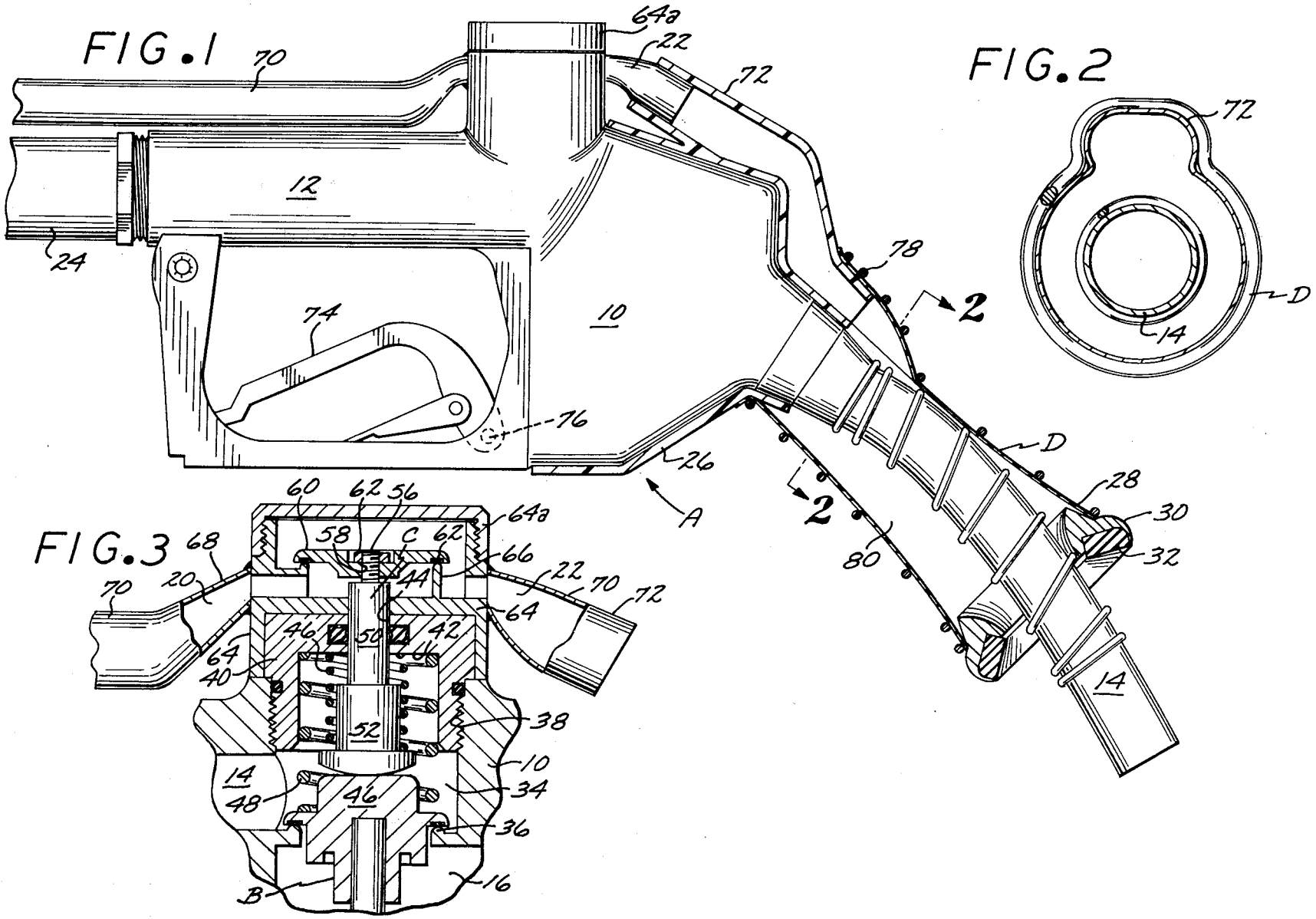
FIG. 1 is a side elevational view of the anti-pollution nozzle assembly.
FIG. 2 is a transverse, cross-sectional view of the device taken on the line 2—2 of FIG. 1.
FIG. 3 is a fragmentary, cross-sectional view of the nozzle assembly illustrating the valving situated within the interior thereof.

The anti-pollution nozzle device A, as may be seen in the drawings, includes a valve body 10 having a rearwardly extending, tubular handle 12 and a forwardly extending nozzle 14. The valve body 10 has first and second elongate passages 16 and 18 defined therein through which liquid fuel flows. Control of liquid fuel through the first and second passages 16 and 18, is controlled by a first spring-loaded valve B, best seen in FIG. 3. The valve body 10 also defines third and fourth passages 20 and 22 with communication between these passages being controlled by a second spring-loaded valve member C as shown in FIG. 3. A hose 24 of a flexible character is connected to the valve body 10 and supplies liquid fuel to the first passage 16 from a pump (not shown).

A resilient shroud D is provided, as may be seen in FIG. 1, that has a first end portion 26 and second end portion 28. The first end portion 26 is secured to the forward portion of the body 10. The second end portion 28 of the shroud supports a ring-shaped body 30, and this body in turn supporting a ring-shape resilient pad 32 that has a radially and inwardly tapered forward surface that sealingly engages the free end of a fuel inlet tube (not shown) on a vehicle fuel tank, likewise not shown. A cavity 34 is defined in the valve body 10 at the intersection of the first and second passages 14 and 16, with this cavity being partially defined by a circular valve seat 36. Threads 38 are formed on the portion of the valve body defining the cavity 34, with these threads being engaged by an externally threaded, cup-shaped plug 40, which plug has an internal surface 42. A bore 44 extends upwardly in the center portion of the plug 40. First valve member B includes a head 46 that is at all times urged downwardly into sealing contact with first valve seat 36 by a compressed first helical spring 48 that has one end thereof in abutting contact with the head, and the other end in abutting contact with the internal surface 42, as shown in FIG. 3. The second valve member C includes a stem 50 that is sealingly supported in the bore 44, with the stem 50 on the lower end thereof developing into an enlarged portion 52. A second compressed helical spring 54 encircles the stem 50, with one end of the second spring 54 being in abutting contact with the enlarged portion 52 of second valve member C, and the other end in abutting contact with the surface 42. The stem 50, on the upper end thereof, has an externally threaded stud 56 projecting upwardly therefrom. The stud 56 engages a tapped bore 58 formed in a valve plate 60, which valve plate supports a resilient ring 62.

A lock nut 62 holds the valve plate 60 at a desired elevation on the stud 56. A cap 64 is mounted on the plug 40, and has a second cylindrical valve seat 66 defined within the interior thereof, and the resilient ring 62 at all times being urged into sealing contact with the second valve seat due to the compressed second helical spring 46. The cap 64 has first and second tubes 68 and 70 extending outwardly therefrom with the first tube being in communication with a hose 70 that extends to a power operated vacuum pump (not shown). The second tube 70 engages a rearwardly extending tubular portion 72 of the shroud D. The cap 64 preferably has an upper threaded portion 64*a* that can be removed therefrom when desired.

The first and second valve members are moved from the first towards the second positions, by use of the handly 74 pivotally supported from the valve body 10 by a pin 76, as shown in FIG. 1. A resilient helical spring 78 is secured to the shroud D as may be seen in FIG. 1, and tends at all times to maintain the shroud in an outwardly extending position. The shroud D and the external surface of the nozzle 14 cooperate to define an annulus-shaped space 80 that is at all times in communication with the fourth passage 22.

The use of the present invention is similar to the use of the fuel tank filling device shown in our U.S. Pat. No. 3,907,010, with the exception that the shroud D does not interlock with the free end of the fuel filling tube (not shown). When the pressure inside is used, the nozzle 14 is inserted in the fuel inlet tube (not shown) and moved downwardly therein until the resilient pad 32 is in pressure-sealing contact with the free end of the fuel tank. When fuel is discharged through the nozzle, communication is established between the third and fourth passages 20 and 22 by upward movement of the valve passage 60 relative to the valve seat 66. Due to the negative pressure maintained in the third and fourth passages 20 and 22, vapor from the fuel is withdrawn from the fuel tank as liquid fuel is discharged into the tank. The valve head 46 and the first valve seat 36 are so related to the size of the second valve seat 66 and valve passage 30 that the degree of vacuum maintained in the fourth passage 22 as the second valve member moves from the first to the second positions is such that the ratio at which fuel vapor is withdrawn from the tank is proportional to the ratio at which fuel is discharged from the tank. With the invention herein described it is possible to so regulate the latter that the rate at which the volume of fuel vapor is withdrawn from the fuel tank is the same as the volume of fuel discharged therein. The nut 62 permits adjustment of the valve passage 60 on the stem 56, and as a result the valve passage can be at such elevation on the stud 56 that the resilient member 62 will be in sealing contact with the second valve seat 66, when the valve head 46 is in sealing engagement with the first valve seat 36.

The use and operation of the invention has been described previously in detail and need not be repeated.

We claim:

1. A device for use in dispensing a volatile liquid hydrocarbon fuel into the fuel inlet tube of a tank without vapor of said fuel escaping to the ambient atmosphere from a first end of said inlet tube, said device including:

a. a valve body assembly that has first and second concurrently operable spring-loaded valve members within the interior thereof that tend to remain in first positions, said first valve member when in said first position obstructing communications between first and second passages in said valve body assembly and said second valve member when in said first position obstructing communications between third and fourth passages in said valve body assembly; and said first and second valve members when moved to second positions so controlling the rate at which liquid fuel discharges into said tank from said second passage relative to the rate at which fuel vapor is withdrawn from said tank through said third and fourth passages that the vapor pressure in said tank is not increased appreciably.

b. first means for supplying said fuel to said first passage from a reservoir for said fuel;

c. a tubular nozzle secured to said valve body assembly and in communication with said second passage, said nozzle of such transverse cross-section as to be slidably inserted in said fuel inlet tube;

d. a resilient longitudinally deformable tubular shroud having first and second end portions, said first end portion of said shroud sealingly supported from said valve body assembly, said shroud cooperating with said nozzle to define an annulus-shaped space therebetween that is in communication with said fourth passage, and said shroud at said second end portion defining a ring-shaped radially tapered surface that sealingly engages said first end of said inlet tube when said nozzle is inserted therein to a predetermined extent;

e. second means for maintaining a negative pressure on said second passage, with said second means in communication with said fuel reservoir; and g. third manually operable means on said valve body for concurrently moving said first and second valve members from said first positions towards second positions whereupon liquid fuel flows through said first and second passages and said nozzle to said tank at a desired rate and fuel vapor displaced by liquid fuel entering said tank being drawn into said annulus-shaped space and through said third and fourth passages by said third means to be returned to said reservoir at substantially said desired rate.

* * * * *